US012704049B2

(12) United States Patent
Shelton et al.

(10) Patent No.: US 12,704,049 B2
(45) Date of Patent: Aug. 11, 2026

(54) ARMING ASSEMBLY FOR A PERFORATING GUN

(71) Applicant: HARRISON JET GUNS II, L.P., Kennedale, TX (US)

(72) Inventors: James F. Shelton, Kennedale, TX (US); Casey Harrison, Kennedale, TX (US); Doug Harrison, Kennedale, TX (US); Holden Harrison, Kennedale, TX (US)

(73) Assignee: Harrison Jet Guns II, L.P., Kennedale, TX (US)

( * ) Notice: Subject to any disclaimer, the term of this patent is extended or adjusted under 35 U.S.C. 154(b) by 0 days.

(21) Appl. No.: 18/878,218

(22) PCT Filed: Jun. 28, 2023

(86) PCT No.: PCT/US2023/026393
§ 371 (c)(1),
(2) Date: Dec. 23, 2024

(87) PCT Pub. No.: WO2024/006315
PCT Pub. Date: Jan. 4, 2024

(65) Prior Publication Data

US 2025/0389173 A1 Dec. 25, 2025

Related U.S. Application Data

(60) Provisional application No. 63/357,192, filed on Jun. 30, 2022.

(51) Int. Cl.
*E21B 43/1185* (2006.01)
*E21B 43/117* (2006.01)

(52) U.S. Cl.
CPC ..... *E21B 43/1185* (2013.01); *E21B 43/117* (2013.01)

(58) Field of Classification Search
CPC ..... E21B 43/11; E21B 43/116; E21B 43/117; E21B 43/1185
See application file for complete search history.

(56) References Cited

U.S. PATENT DOCUMENTS 2,883,932 A * 4/1959 Caldwell ..... E21B 43/118 175/4.53
4,011,815 A 3/1977 Garcia
4,292,895 A 10/1981 Bell et al.
5,159,145 A * 10/1992 Carisella ..... E21B 43/1185 102/222

(Continued)

*Primary Examiner* — Troy Chambers
*Assistant Examiner* — Benjamin S Gomberg
(74) *Attorney, Agent, or Firm* — WARNER NORCROSS + JUDD LLP

(57) ABSTRACT

A detonator arming assembly for a perforating gun is provided. The detonator arming assembly is integrated into the bulkhead of a perforating gun, such that it can be positioned at either end of a shaped charge positioning tube. The detonator arming assembly is armed when a tandem is threaded into the perforating gun. If not armed, a premature detonation of the internal detonator does not initiate a detonation of the internal detonating cord. If armed, a detonation of the internal detonator causes the detonation of a laterally adjacent detonating cord, which is coupled to each shaped charge in the perforating gun.

12 Claims, 4 Drawing Sheets

(56) References Cited

U.S. PATENT DOCUMENTS

| | | | | |
|---|---|---|---|---|
| 8,950,509 | B2 | 2/2015 | Coffey et al. | |
| 11,867,032 | B1 * | 1/2024 | Parks | E21B 43/117 |
| 12,163,406 | B2 * | 12/2024 | Eitschberger | E21B 43/11855 |
| 2007/0267195 | A1 * | 11/2007 | Grigar | F42C 15/188 166/55.1 |
| 2012/0247771 | A1 | 10/2012 | Black et al. | |
| 2013/0199843 | A1 * | 8/2013 | Ross | F42C 15/188 175/4.54 |
| 2014/0083718 | A1 * | 3/2014 | Bell | E21B 43/1185 166/378 |
| 2016/0084048 | A1 | 3/2016 | Harrigan et al. | |
| 2016/0356132 | A1 * | 12/2016 | Burmeister | E21B 43/1185 |
| 2019/0292887 | A1 | 9/2019 | Austin, II et al. | |
| 2020/0048996 | A1 | 2/2020 | Anthony et al. | |
| 2020/0063537 | A1 | 2/2020 | Langford et al. | |
| 2022/0010660 | A1 | 1/2022 | Dyess et al. | |
| 2022/0120547 | A1 * | 4/2022 | Sullivan | F42D 1/05 |
| 2022/0145732 | A1 * | 5/2022 | Anthony | E21B 43/119 |
| 2024/0125214 | A1 * | 4/2024 | Eitschberger | E21B 43/119 |
| 2025/0027390 | A1 * | 1/2025 | Hoelscher | E21B 43/1185 |
| 2025/0043666 | A1 * | 2/2025 | Eitschberger | E21B 43/117 |

* cited by examiner

ARMING ASSEMBLY FOR A PERFORATING GUN

CROSS-REFERENCE TO RELATED APPLICATIONS

This application is a national stage entry under 35 U.S.C. 371 of International Application No. PCT/US2023/026393, filed Jun. 28, 2023, which claims the benefit of U.S. Patent Application 63/357,192, filed Jun. 30, 2022, the disclosures of which are incorporated by reference in their entirety.

TECHNICAL FIELD

The present invention relates to perforating gun systems having penetrating shaped charges to generate entrance holes through a wellbore casing.

BACKGROUND

In oil and gas operations, it is a known practice to install a well casing into a borehole that has been drilled into a geologic formation. A gun string is then lowered into the wellbore on a wireline opposite a hydrocarbon formation. The gun string includes shaped charges that, when fired, are formed into high-velocity jets that penetrate through the wellbore casing. The resulting perforations allow a fluid (oil or gas) to flow into the wellbore.

A gun string will typically include multiple perforating guns, each with opposing box ends having female threads. Tandems having male threads are threaded to one or both ends of each perforating gun in the gun string. In this fashion, multiple perforating guns can be connected end-to-end and simultaneously detonated within the wellbore.

The internal shaped charges are typically detonated by a detonating cord that is triggered by an addressable switch detonator, which is electronically actuated. The detonating cord is coupled to the apex of each shaped charge. In this arrangement, a single detonator at one end of the perforating gun will detonate all of the shaped charges in the perforating gun.

Despite their widespread acceptance for wellbore operations, there remains a continued need for improved perforating gun systems. In particular, there remains a continued need for improved perforating gun systems that guard against accidental detonations of the perorating gun caused by early ignition of the addressable switch detonator.

SUMMARY OF THE INVENTION

A detonator arming assembly for a perforating gun is provided. The detonator arming assembly is integrated into the bulkhead of a perforating gun, such that it can be positioned at either end of a shaped charge positioning tube. The detonator arming assembly can be armed when the perforating gun is joined to a tandem. If not armed, a premature detonation of the internal detonator does not initiate a detonation of the internal detonation cord, and consequently the shaped charges do not fire. Once the perforating gun is joined to a tandem, however, a detonation of the internal detonator causes the detonation of the detonating cord, which is coupled to each shaped charge in the perforating gun.

In one embodiment, the detonator arming assembly includes an arming module that is moveable between a raised position and a lowered position within a bulkhead housing. The arming module is biased in the raised position by a helical compression spring, and the arming module includes an internal detonator, for example an electronically actuated addressable switch detonator. In the raised position, the detonator is axially offset from a detonating cord cavity within the bulkhead housing. The lowermost extent of the detonator is separated from the detonating cord cavity by a sidewall, or other physical obstruction, to thereby prevent a sympathetic detonation of a detonating cord. In the lowered position, however, the detonator is laterally adjacent to an open portion of the detonating cord cavity, whereby a detonation of the detonator causes a detonation of the detonating cord.

In another embodiment, the bulkhead housing is joined to the shaped charge positioning tube by interference fit and includes a contact pin for receiving a firing signal from an adjacent tandem. The arming module is laterally offset from the connector pin, and the bulkhead housing includes a latch for retaining the arming module in the lowered position. In the lowered position, the detonator arming assembly is armed, and the uppermost extent of the arming module is flush with the uppermost extent of the bulkhead housing. In addition, the bulkhead housing can include a plurality of radial spokes coupled to an outer ring for attachment to the shaped charge positioning tube.

In another embodiment, a perforating gun is provided. The perforating gun includes an outer gun barrel, an internal shaped charge positioning tube, and first and second bulkheads, at least one of which includes an integrated arming assembly. The arming assembly can be armed on-site by lowering the arming module to the fully seated position or by threadably engaging the perforating gun to adjacent tandems. The tandems include a socket opening for receiving a spring-biased contact pin, which is in electrical communication with the detonator within the arming module. The perforating gun, as part of a gun string, is then lowered into a wellbore having a wellbore casing, and a firing signal causes the shaped charges to detonate, creating a plurality of perforations through the wellbore casing.

These and other features and advantages of the present invention will become apparent from the following description of the invention, when viewed in accordance with the accompanying drawings and appended claims.

Before embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. In addition, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION

The following detailed description is merely exemplary in nature and is not intended to limit the oilfield perforating systems and methods as described herein. Furthermore, there is no intention to be bound by any theory presented in the preceding background or the following detailed description. The description is not in any way meant to limit the scope of any present or subsequent related claims.

As used here, the terms "above" and "below"; "up" and "down"; "upper" and "lower"; "upwardly" and "downwardly"; and other like terms indicating relative positions above or below a given point or element are used in this description to more clearly describe some embodiments. However, when applied to equipment and methods for use in wells that are deviated or horizontal, such terms may refer to a left to right, right to left, or diagonal relationship as appropriate.

A detonator arming assembly in accordance with an exemplary embodiment is illustrated in FIGS. 1-4 and generally designated 10. The detonator arming assembly 10 is integrated into the bulkhead of a perforating gun, such that it can be positioned at either end of a shaped charge positioning tube. The detonator arming assembly is armed when a tandem is threaded into the perforating gun. If not armed, a premature detonation of the internal detonator does not initiate a detonation of the internal detonation cord. If armed, however, a detonation of the detonator causes the detonating cord to detonate, which is coupled to the apex of each shaped charge in the perforating gun. In this arrangement, a single detonator within the bulkhead can safely detonate all shaped charges in the perforating gun.

Figure 1:
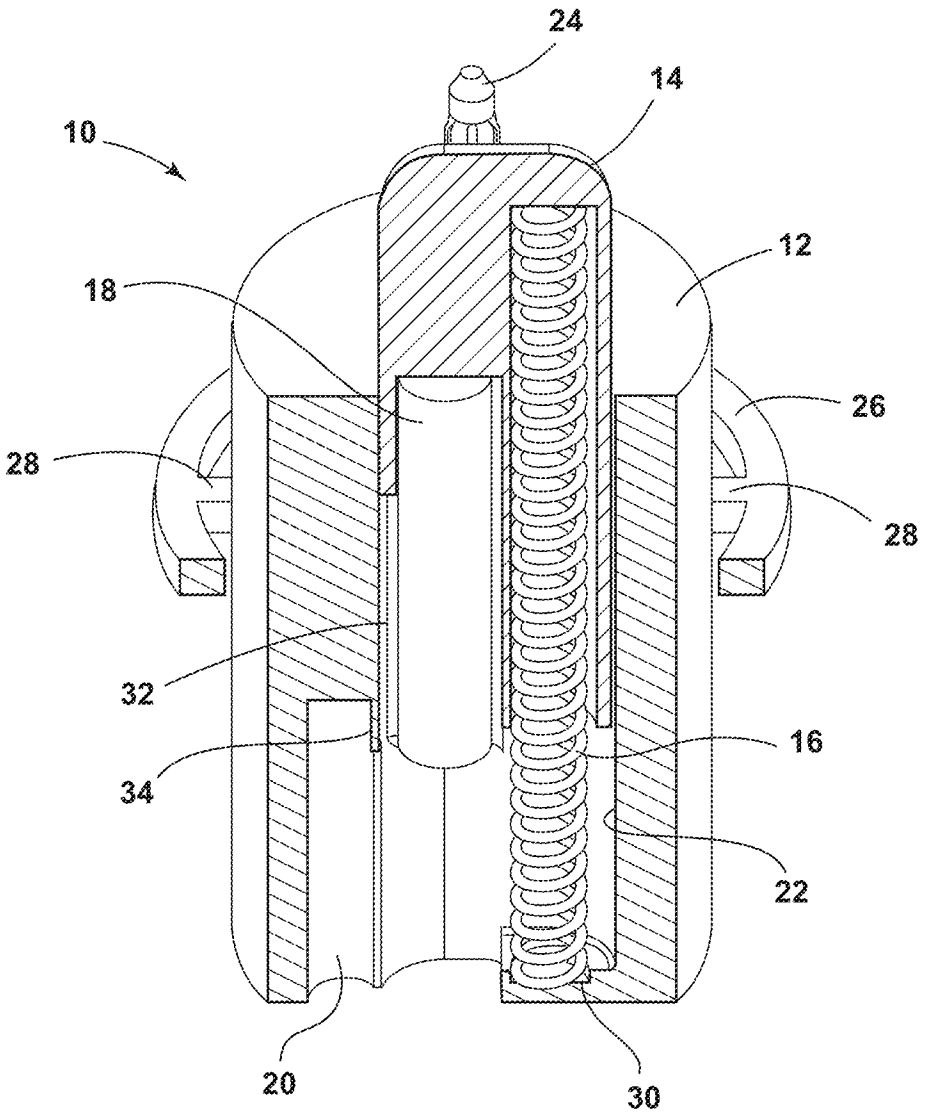
FIG. 1 is a cross-sectional view of a detonator arming assembly integrated into a bulkhead of a perforating gun.

As more specifically shown in FIG. 1, the detonator arming assembly 10 includes a bulkhead housing 12, an arming module 14, an internal spring 16, and an internal detonator 18. The bulkhead housing 12 is formed from an electrically insulating material, for example molded plastic, and the bulkhead housing 12 is configured to be partially received within an open end of a shaped charge positioning tube by interference fit. The bulkhead housing 12 includes a detonating cord cavity 20 for a detonating cord, and the bulkhead housing 12 also includes an axial opening 22 for the arming module 14. A contact pin 24 extends from the bulkhead housing 12 for receiving a firing signal from an adjacent tandem.

As also shown in FIG. 1, the detonating cord cavity 22 is laterally adjacent to the axial opening 22 for the arming module 14. In addition, the detonating cord cavity 20 is sized to receive an end portion of a detonating cord. One end of a detonating cord is received in the detonating cord cavity 20, and the remainder of the detonating cord extends through the shaped charge positioning tube in proximity to the apex of each shaped charge, such that a detonation of the detonating cord causes a detonation of each shaped charge. The bulkhead housing 12 also includes a ring 26 supported by a plurality of radial spokes 28. As discussed below in connection with FIG. 4, the segmented end portion of a shaped charge positioning tube is inserted between adjacent spokes 28, and the ring 26 engages an outer gun barrel.

The arming module 14 moves within the axial opening 22 between a raised (extended) position and a lowered (seated) position. The arming module 14 comprises a plunger in the illustrated embodiment, being biased in the raised position by the helical compression spring 16. The spring 16 is supported at a lower end by a spring seat 30 that is integrally formed in the bulkhead housing 12. The arming module 14 also includes a chamber 32 for the internal detonator 18. The internal detonator 18 comprises an addressable switch in the current embodiment, which is responsive to a firing signal from the contact pin 24.

Figure 2:
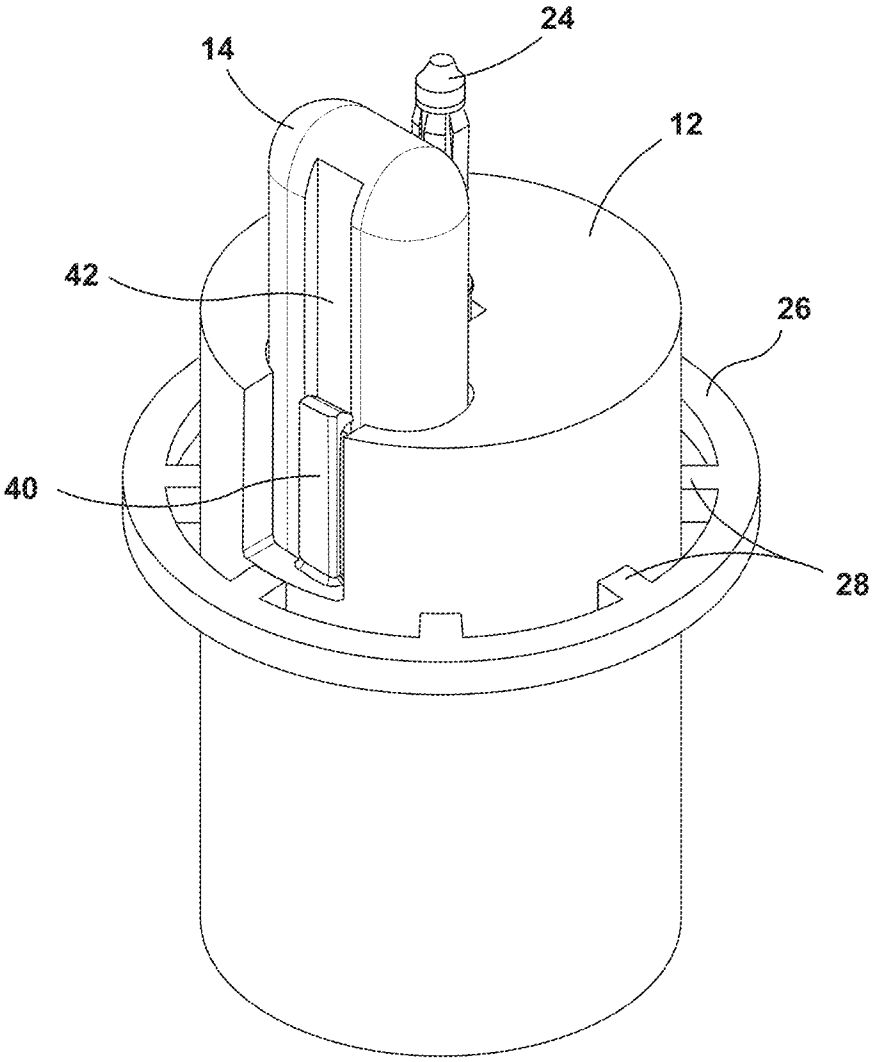
FIG. 2 is a perspective view of the detonator arming assembly of FIG. 1 in the dis-armed position.
Figure 3:
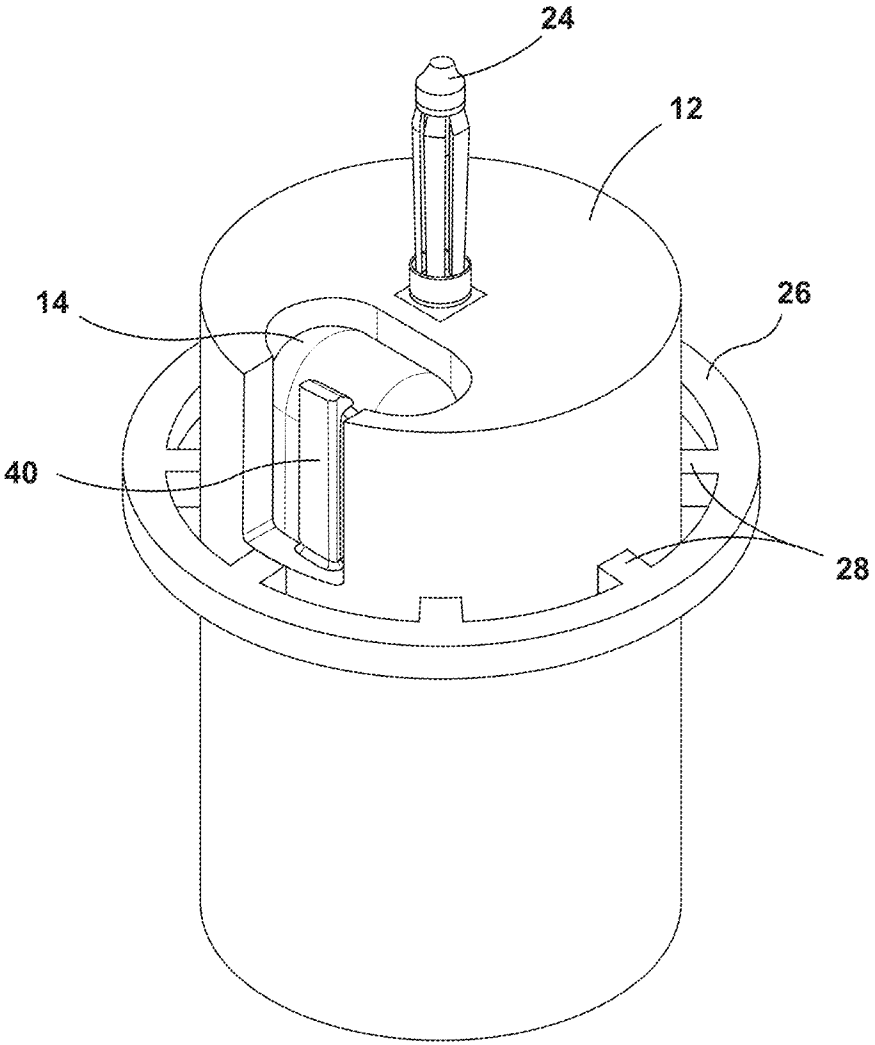
FIG. 3 is a perspective view of the detonator arming assembly of FIG. 1 in the armed position.

The dis-armed position of the arming module 14 is illustrated in FIG. 2. In this position, the arming module 14 extends from the bulkhead housing 12. An accidental detonation of the internal detonator 18 (contained in the arming module) does not initiate a detonation of the detonating cord, because the internal detonator 18 is raised relative to the end of the detonating cord (contained in the detonating cord cavity 20). In the raised position, the lowermost extent of the detonator 18 is separated from the detonating cord cavity 20 by a sidewall 34, or other physical obstruction, to thereby prevent a sympathetic detonation of a detonating cord. The armed position of the arming module 14 is illustrated in FIG. 3. In this position, the arming module 14 is fully seated in the bulkhead housing 12, with the uppermost portion of the arming module 14 being flush with the uppermost portion of the bulkhead housing 12. In the armed position, the detonator 18 is laterally adjacent to the detonating cord cavity 20 along the entire length of the detonator 18 or substantially the entire length of the detonator 18. A resilient latch 40 retains the arming module 14 in this lowered position. The resilient latch 40 is integrally formed with the bulkhead housing 12, and the arming module 14 includes a vertical groove 42 in alignment with the resilient latch 40.

Figure 4:
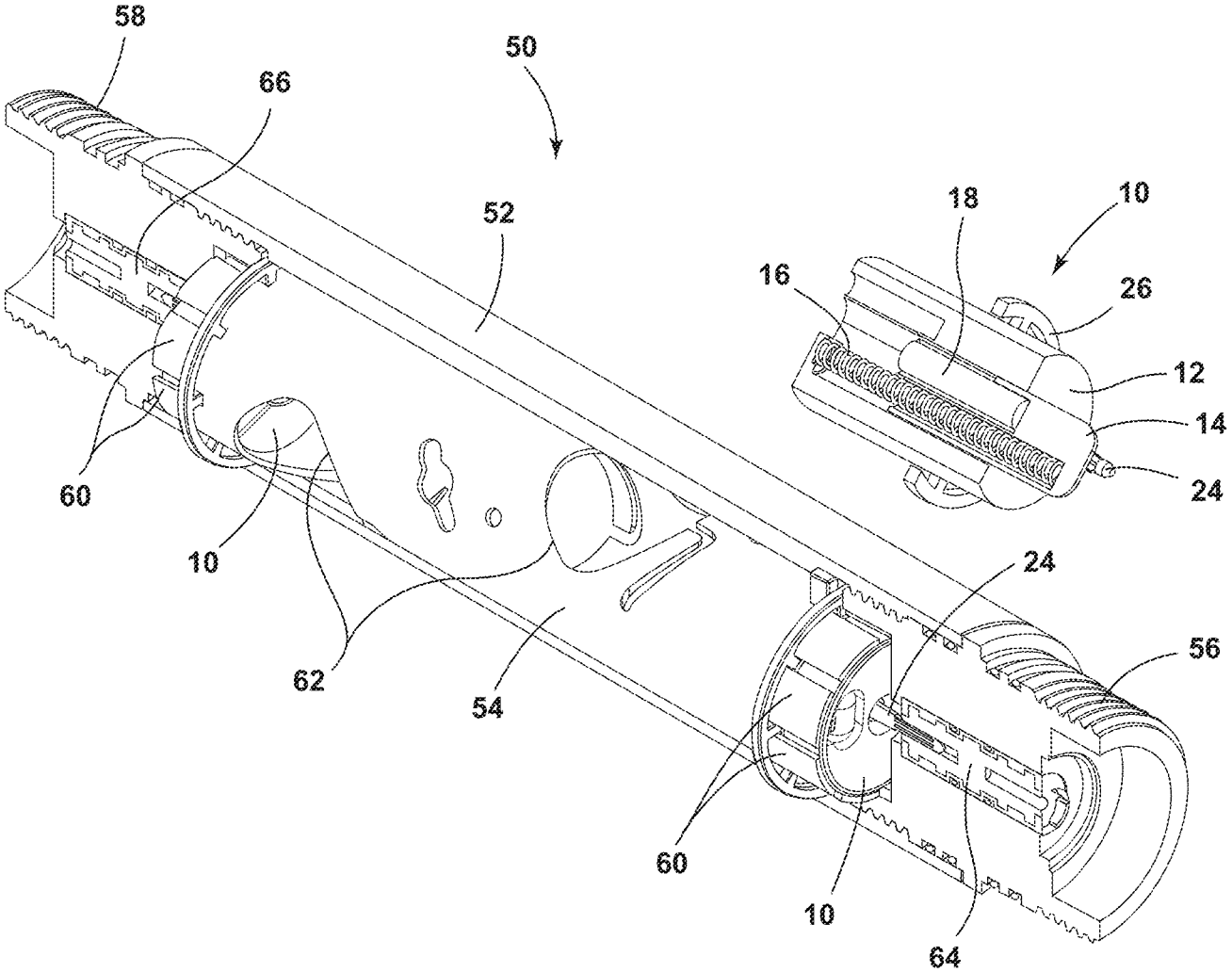
FIG. 4 is a cross-sectional view of a perforating gun including the detonator arming assembly of FIG. 1.

A perforating gun 50 including the arming assembly 10 of FIGS. 1-3 is illustrated in FIG. 4. The perforating gun 50 includes an outer gun barrel 52 and an internal shaped charge positioning tube 54, and the perforating gun 50 is joined to first and second tandems 56, 58. The outer gun barrel 52 includes opposing box ends, and the tandems 56, 58 are threaded to the respective box ends of the outer gun barrel 52 so that two or more perforating guns can be joined in series in a gun string. The outer gun barrel 52 is cylindrical and includes a length that is greater than the length of the shaped charge positioning tube 54, such that the outer gun barrel 52 extends beyond the shaped charge positioning tube 54.

The shaped charge positioning tube 54 is formed from an electrically conductive material, for example stainless steel. Each end portion of the shaped charge positioning tube 54 defines a plurality of longitudinal slots, such that the shaped charge positioning tube 54 includes castellated or segmented end portions 60. The shaped charge positioning tube 54 also includes a cylindrical body having multiple shaped charge openings 62 that receive a corresponding number of shaped charges. The openings 62 are angularly offset from each other in the current embodiment, but can be in axial alignment in other embodiments. As also shown in FIG. 4, the first tandem 56 includes a first pass-through element 64 and the second tandem 58 includes a second pass-through element 66. In operation, the firing signal is passed through the first tandem 56 to the perforating gun 50 and subsequently to the second tandem 58 to an adjacent perforating gun. A signal fire wire (not shown) extends between the two bulkhead housings 10 to allow the firing signal to directly pass to adjacent perforating guns.

The above description is that of current embodiments of the invention. Various alterations and changes can be made without departing from the spirit and broader aspects of the invention as defined in the appended claims, which are to be interpreted in accordance with the principles of patent law including the doctrine of equivalents. Any reference to elements in the singular, for example, using the articles "a," "an," "the," or "said," is not to be construed as limiting the element to the singular.

What is claimed is:

1. An arming assembly for a perforating gun, the arming assembly comprising:

a bulkhead housing defining a detonating cord cavity and an axial opening, the detonating cord cavity being laterally adjacent to the axial opening, wherein the bulkhead housing includes a spring seat at a distal end of the axial opening, an arming module within the axial opening and including a detonator therein, the arming module being movable between a raised position and a lowered position, the arming module being spring-biased in the raised position by a compression spring that is supported by the spring seat, an electrically conductive connector pin for transferring a firing signal to the detonator, the connector pin protruding from an upper axial surface of the bulkhead housing and being laterally offset from the axial opening, wherein the arming module extends from the upper axial surface of the bulkhead housing in the raised position such that the detonator is axially offset from the detonating cord cavity, and wherein the arming module is seated within the axial opening in the lowered position such that the detonator is laterally adjacent to an open portion of the detonating cord cavity, wherein the arming module is dis-armed in the raised position and armed in the lowered position.

2. The arming assembly of claim 1, wherein the bulkhead housing is formed from a non-conductive material.

3. The arming assembly of claim 1, wherein the bulkhead housing includes a plurality of radial spokes coupled to an outer ring.

4. The arming assembly of claim 1, wherein the bulkhead housing includes a resilient latch for retaining the arming module in the lowered position.

5. The arming assembly of claim 1, wherein the connector pin includes a stem that protrudes from the bulkhead housing, the stem including a plurality of resiliently deformable arms that bow outward between a tip of the stem and a base of the stem.

6. A perforating gun comprising:

an outer gun barrel;

a shaped charge positioning tube within the outer gun barrel; and an arming assembly joined to the shaped charge positioning tube, the arming assembly comprising:

a bulkhead housing defining a detonating cord cavity and an axial opening, the detonating cord cavity being laterally adjacent to the axial opening, wherein the bulkhead housing includes a spring seat at a distal end of the axial opening, an arming module that is slideably movable within the axial opening between a raised position and a lowered position, the arming module being spring-biased in the raised position by a compression spring that is supported by the spring seat, and a detonator within the arming module, wherein the detonator is axially offset from the detonating cord cavity when the arming module is in the raised position, and wherein the detonator is laterally adjacent to an open portion of the detonating cord cavity when the arming module is in the lowered position, an electrically conductive connector pin for transferring a firing signal to the detonator, the electrically conductive connector pin protruding from an upper axial surface of the bulkhead housing and being laterally offset from the axial opening, wherein the arming module is moveable from the raised position to the lowered position in response to attachment of the outer gun barrel to a tandem, such that a detonation of the detonator while the arming module is in the lowered position occurs immediately adjacent to the detonating cord cavity.

7. The perforating gun of claim 6, wherein the bulkhead housing is formed from a non-conductive material and wherein the shaped charge positioning tube is formed from metal.

8. The perforating gun of claim 6, wherein the bulkhead housing includes a plurality of radial spokes coupled to an outer ring.

9. The perforating gun of claim 8, wherein the shaped charge positioning tube includes a segmented end portion extending between adjacent ones of the plurality of radial spokes.

10. The perforating gun of claim 6, wherein the bulkhead housing is secured within an end portion of the shaped charge positioning tube by interference fit.

11. The perforating gun of claim 6, wherein the bulkhead housing includes a resilient latch for retaining the arming module in the lowered position.

12. The perforating gun of claim 6, wherein the arming module is radially offset from the connector pin.

* * * * *